US007938261B1

(12) United States Patent
Lee

(10) Patent No.: US 7,938,261 B1
(45) Date of Patent: May 10, 2011

(54) HAND TOOL DISPLAY BOX

(75) Inventor: Pei-Yang Lee, Dongshi Township (TW)

(73) Assignee: Kung-Cheng Chen, Taichung (TW)

( * ) Notice: Subject to any disclaimer, the term of this patent is extended or adjusted under 35 U.S.C. 154(b) by 0 days.

(21) Appl. No.: 12/635,503

(22) Filed: Dec. 10, 2009

(51) Int. Cl.
*B65D 85/20* (2006.01)

(52) U.S. Cl. ..... 206/376; 206/372; 206/349

(58) Field of Classification Search ..... 206/349, 206/372, 373, 376, 377, 378; 211/70.6, 60.1
See application file for complete search history.

(56) References Cited

U.S. PATENT DOCUMENTS

| | | | | |
|---|---|---|---|---|
| 6,375,005 | B1 * | 4/2002 | McCann | 206/349 |
| 6,637,606 | B1 * | 10/2003 | Chen | 211/70.6 |
| 6,679,391 | B1 * | 1/2004 | Huang | 211/70.6 |
| 6,712,224 | B2 * | 3/2004 | Ling | 211/70.6 |
| 6,832,684 | B2 * | 12/2004 | Huang | 206/376 |
| 7,055,689 | B2 * | 6/2006 | Chen | 206/376 |
| 7,559,427 | B2 * | 7/2009 | Hu | 206/764 |
| 2002/0027092 | A1 * | 3/2002 | Hu | 206/378 |
| 2002/0070185 | A1 * | 6/2002 | Chen | 211/70.6 |
| 2002/0162763 | A1 * | 11/2002 | Chow | 206/349 |
| 2004/0089620 | A1 * | 5/2004 | Chen | 211/70.6 |
| 2007/0007156 | A1 * | 1/2007 | Wu | 206/376 |

* cited by examiner

*Primary Examiner* — David T Fidei
(74) *Attorney, Agent, or Firm* — Hershkovitz & Associates, LLC; Abraham Hershkovitz

(57) ABSTRACT

A hand tool display box has a base, a holding device and a simulation device. The base has a baseboard, an annular flange, a through hole and a mounting seat. The annular flange is formed around and protrudes from the baseboard. The mounting seat is formed on and protrudes from the baseboard. The holding device is mounted on the base and has a holding frame and a covering panel. The holding frame is mounted on the baseboard in the through hole and has multiple mounting recesses, multiple clamping ribs and a locking recess. The covering panel is rotatably connected to the holding frame and has a finger tab and a locking panel. The simulation device is rotatably connected to the mounting seat of the base and has a mounting disk, a rotating shaft and an engaging ring.

11 Claims, 10 Drawing Sheets

HAND TOOL DISPLAY BOX

BACKGROUND OF THE INVENTION

1. Field of the Invention

The present invention relates to a display box, and more particularly to a hand tool display box that can provide a burglarproof effect and can simulate operating status.

2. Description of the Prior Art

When hand tools, such as screwdrivers, wrenches are sold, a conventional display box is used to store and display the hand tools.

Although the conventional display box can provide display and storage effects, the conventional display box does not have a burglarproof structure or device to prevent the hand tools from being lost or stolen.

To overcome the shortcomings, the present invention tends to provide a hand tool display box to mitigate the aforementioned problems.

SUMMARY OF THE INVENTION

The main objective of the present invention is to provide a hand tool display box that can provide a burglarproof effect and can simulate operating status.

The hand tool display box in accordance with the present invention has a base, a holding device and a simulation device. The base has a baseboard, an annular flange, a through hole and a mounting seat. The annular flange is formed around and protrudes from the baseboard. The mounting seat is formed on and protrudes from the baseboard. The holding device is mounted on the base and has a holding frame and a covering panel. The holding frame is mounted on the baseboard in the through hole and has multiple mounting recesses, multiple clamping ribs and a locking recess. The covering panel is rotatably connected to the holding frame and has a finger tab and a locking panel. The simulation device is rotatably connected to the mounting seat of the base and has a mounting disk, a rotating shaft and an engaging ring.

Other objects, advantages and novel features of the invention will become more apparent from the following detailed description when taken in conjunction with the accompanying drawings.

DETAILED DESCRIPTION OF THE PREFERRED EMBODIMENT

Figure 1:
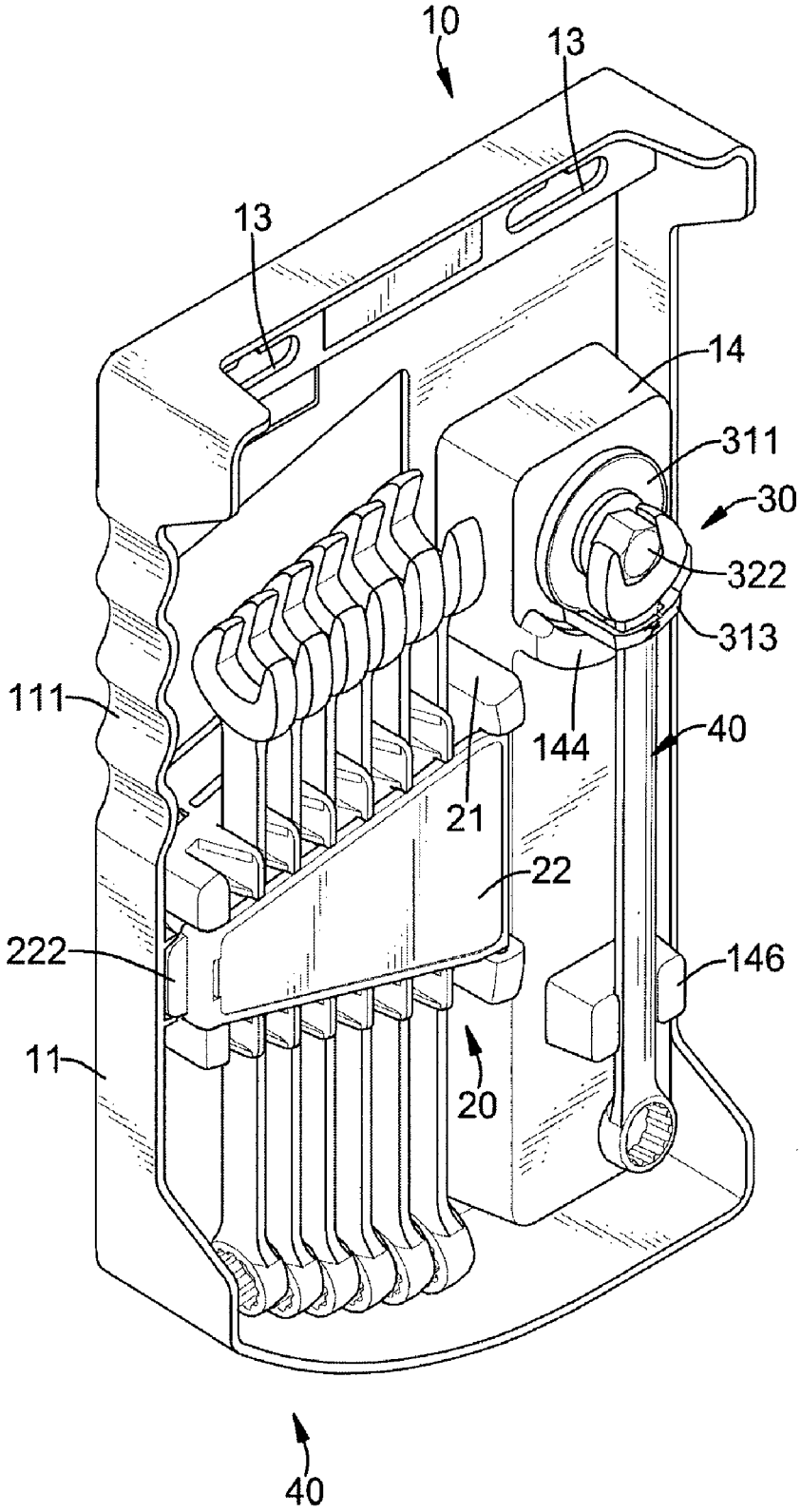
FIG. 1 is a perspective view of a hand tool display box in accordance with the present invention, showing hand tools held by the display box.

With reference to FIGS. 1 to 4, a hand tool display box in accordance with the present invention for holding hand tools (40) has a base (10), a holding device (20) and a simulation device (30).

The base (10) may be rectangular, is hung on a surface, such as a wall and has a baseboard, an annular flange (11), a through hole (12), at least one hanging hole (13) and a mounting seat (14).

The baseboard has an upper end, a lower end, a first side, a second side and an outer face. The annular flange (11) is formed around and protrudes from the ends and the sides of the baseboard and has a finger recess (111). The finger recess (111) is formed on the annular flange (11) near the upper end of the baseboard to allow a user to hold the base (10) easily. Preferably, the annular flange (11) is curved at the lower end of the baseboard. The through hole (12) may be trapezoidal and is formed through the baseboard near the finger recess (111) of the annular flange (11). Preferably, the base (10) has multiple connecting protrusions (121) formed in the through hole (12) and protrude from the outer face of the baseboard. The at least one hanging hole (13) is formed through the top end of the baseboard.

Figure 9:
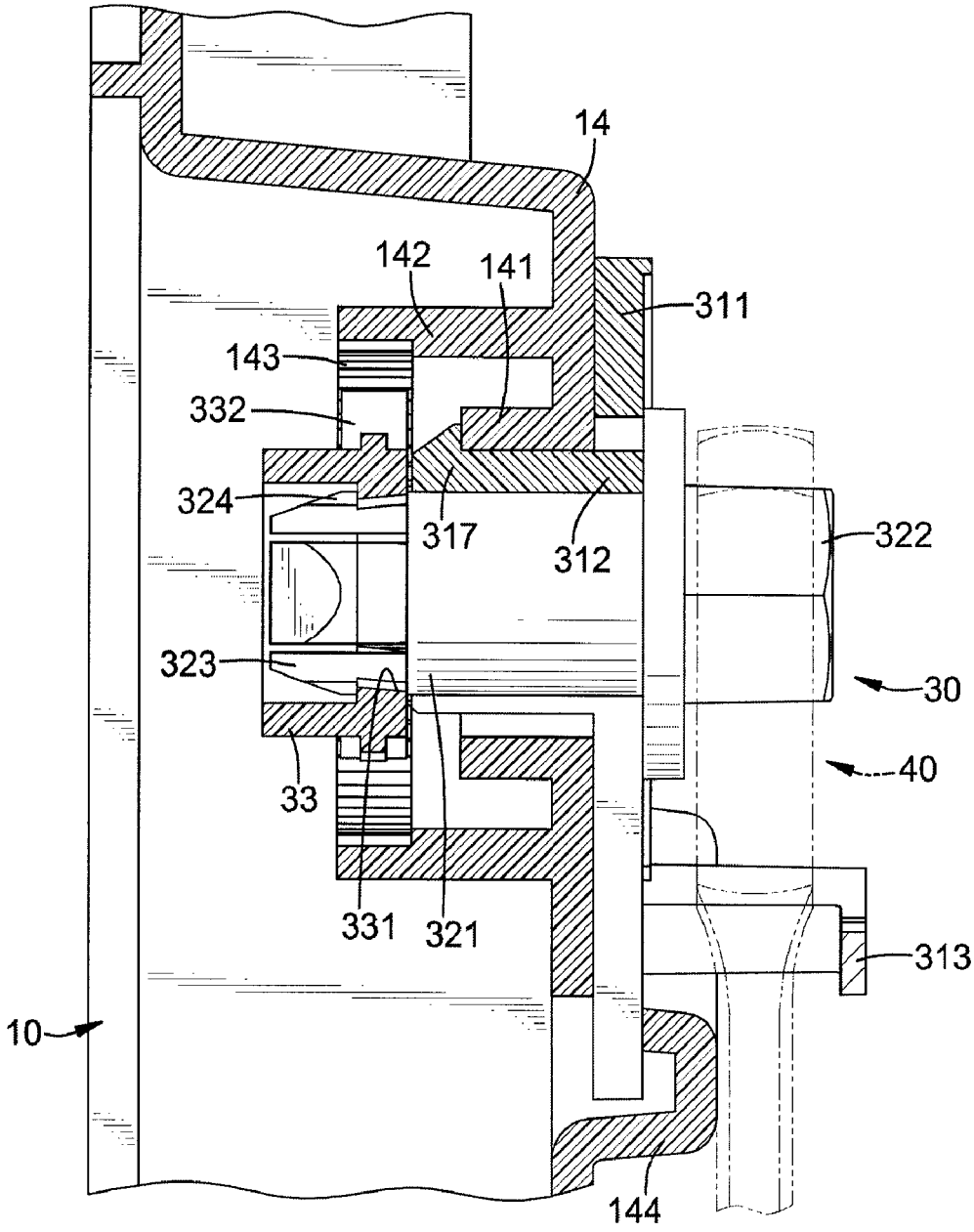
FIG. 9 is another enlarged side view in partial section of the hand tool display box in FIG. 1.

With further reference to FIG. 9, the mounting seat (14) is formed on and protrudes from the baseboard of the base (10) between the second side and the ends of the baseboard and the through hole (12) and has a rear surface, a front surface, a connecting pipe (141), a mounting tube (142), a limiting protrusion (144) and a holding mount (146).

The connecting pipe (141) is formed on and protrudes from the rear surface of the mounting seat (14) near the top end of the baseboard of the base (10), is formed through the front surface of the mounting seat (14) and has a free end. The mounting tube (142) is formed on and protrudes from the rear surface of the mounting seat (14) around the connecting pipe (141) and has an internal surface, an open end and multiple ratchet teeth (143). The ratchet teeth (143) are formed on the internal surface of the mounting tube (142) near the open end.

The limiting protrusion (144) may be curved, is formed on and protrudes from the front surface of the mounting seat (14) near the connecting pipe (141) and has an upper face and a guiding groove (145). The upper face of the limiting protrusion (144) faces the upper end of the baseboard. The guiding groove (145) is formed through the upper face of the limiting protrusion (144). The holding mount (146) is formed on and protrudes from the front surface of the mounting seat (14) near the lower end of the baseboard of the base (10) and has a holding recess (147). The holding recess (147) is formed in the holding mount (146).

With reference to FIGS. 4 to 8, the holding device (20) is mounted on the base (10) and has a holding frame (21) and a covering panel (22).

The holding frame (21) is mounted on the baseboard of the base (10) in the through hole (12) and has a rear side, a front side, a locking end (211), a connecting end (212), multiple mounting recesses (213), multiple clamping ribs (214), a locking recess (215), a holding segment (216) and a panel recess (217). The rear side of the holding frame (21) is formed with the connecting protrusions (121) of the base (10). The locking end (211) of the holding frame (21) is adjacent to the annular flange (11) near the finger recess (111). The connecting end of the holding frame (21) is adjacent to the mounting seat (14) of the base (10) and has a middle. The mounting recesses (213) are formed in the holding frame (21) at intervals. The clamping ribs (214) may be curved, are formed on the holding frame (21) and extend into the mounting recesses (213).

The hand tools such as combination box and open end wrenches (40) can be mounted in the mounting recesses (213) and clamped by the clamping tabs (214) of the holding frame (21). The locking recess (215) is formed in the locking end (211) of the holding frame (21) near the rear side of the holding frame (21). The holding segment (216) is formed on and protrudes inward from the middle of the connecting end (212) of the holding frame (21). The panel recess (217) is formed through the rear side of the holding frame (21) in the connecting end (212).

The covering panel (22) is pivotally connected to the holding frame (21) and has a pivotal end, a locking end, two pivotal rods (221), a finger tab (222) and a locking panel (223). The pivotal end of the covering panel (22) is pivotally connected to the connecting end (212) of the holding frame (21) and abuts with the holding segment (216) of the holding frame (21). The pivotal rods (221) are formed on and protrude from the pivotal end of the covering panel (22) and are rotatably mounted in the panel recess (217) of the holding frame (21). The finger tab (222) is formed on and protrudes from the locking end of the covering panel (22) and has an inner face and an outer face.

Figure 8:
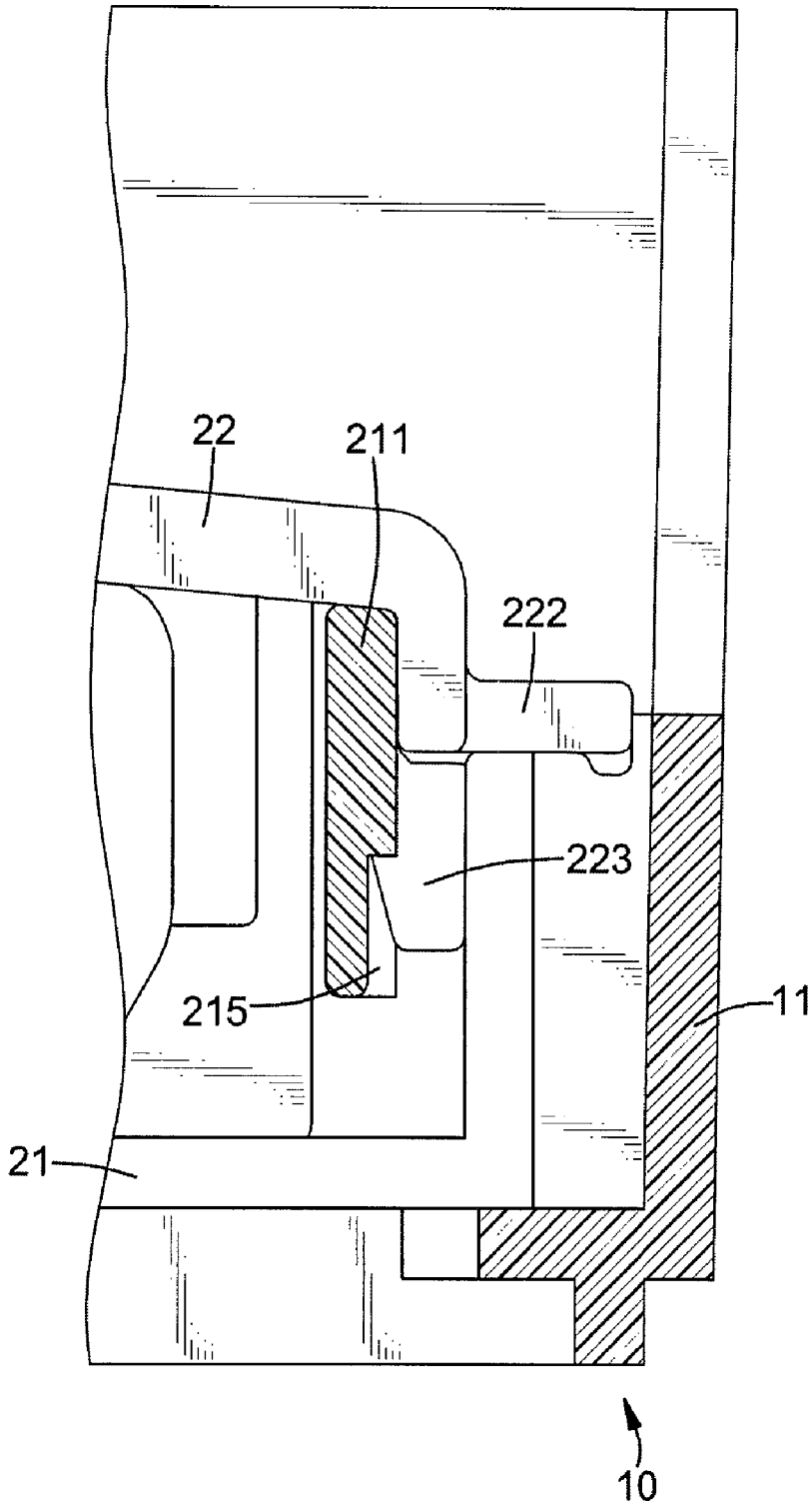
FIG. 8 is an enlarged top view in partial section of the hand tool display box in FIG. 1.

With reference to FIG. 8, when the locking ends of the covering panel (22) and the holding frame (21) are connected to each other, the outer face of the finger tab (222) is parallel with an outer side of the annular flange (11) of the base (10). The locking panel (223) is formed on and protrudes from the inner face of the finger tab (222) and is locked in the locking recess (215) of the holding frame (21).

Figure 2:
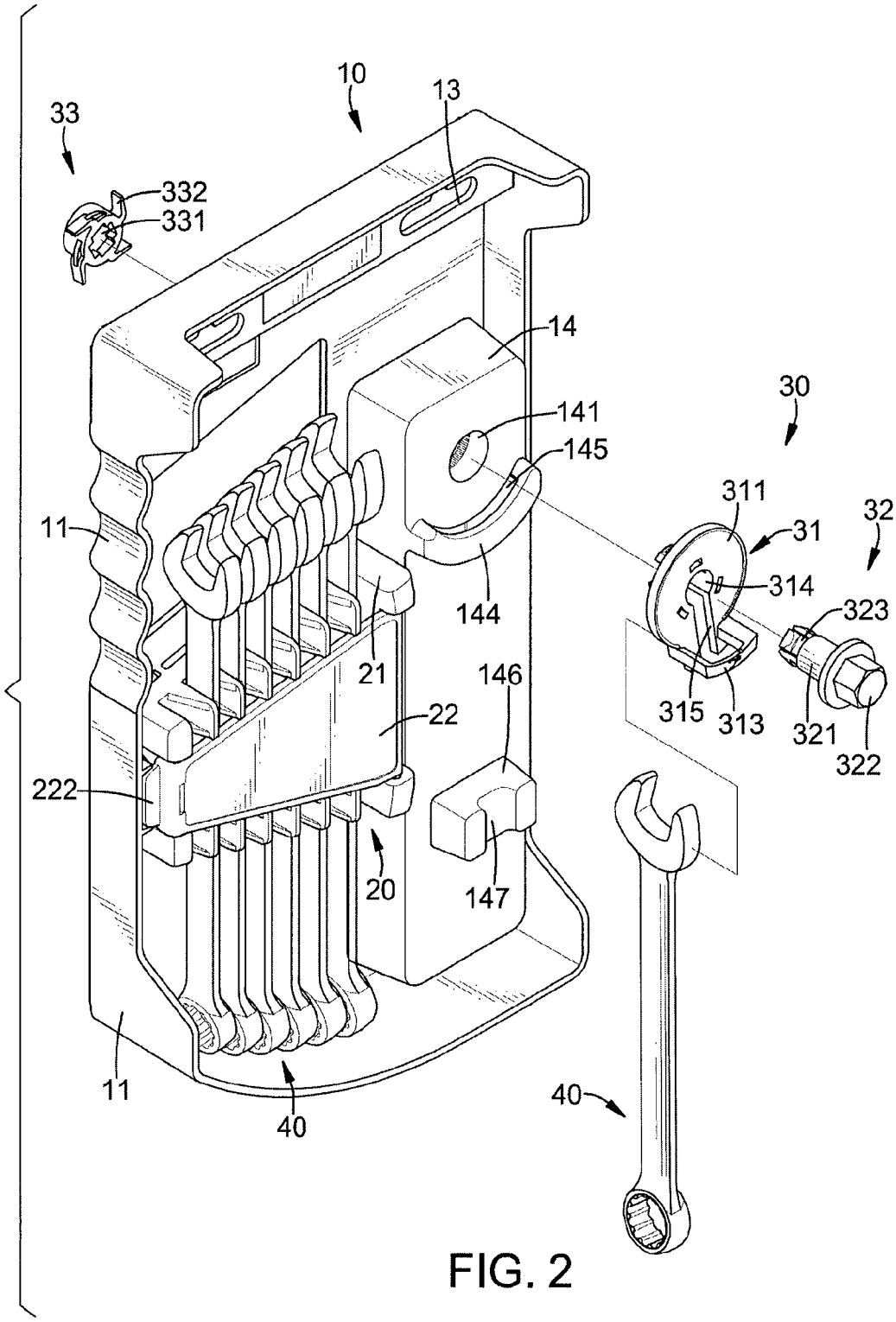
FIG. 2 is an exploded perspective view of a simulation device of the hand tool display box in FIG. 1.
Figure 3:
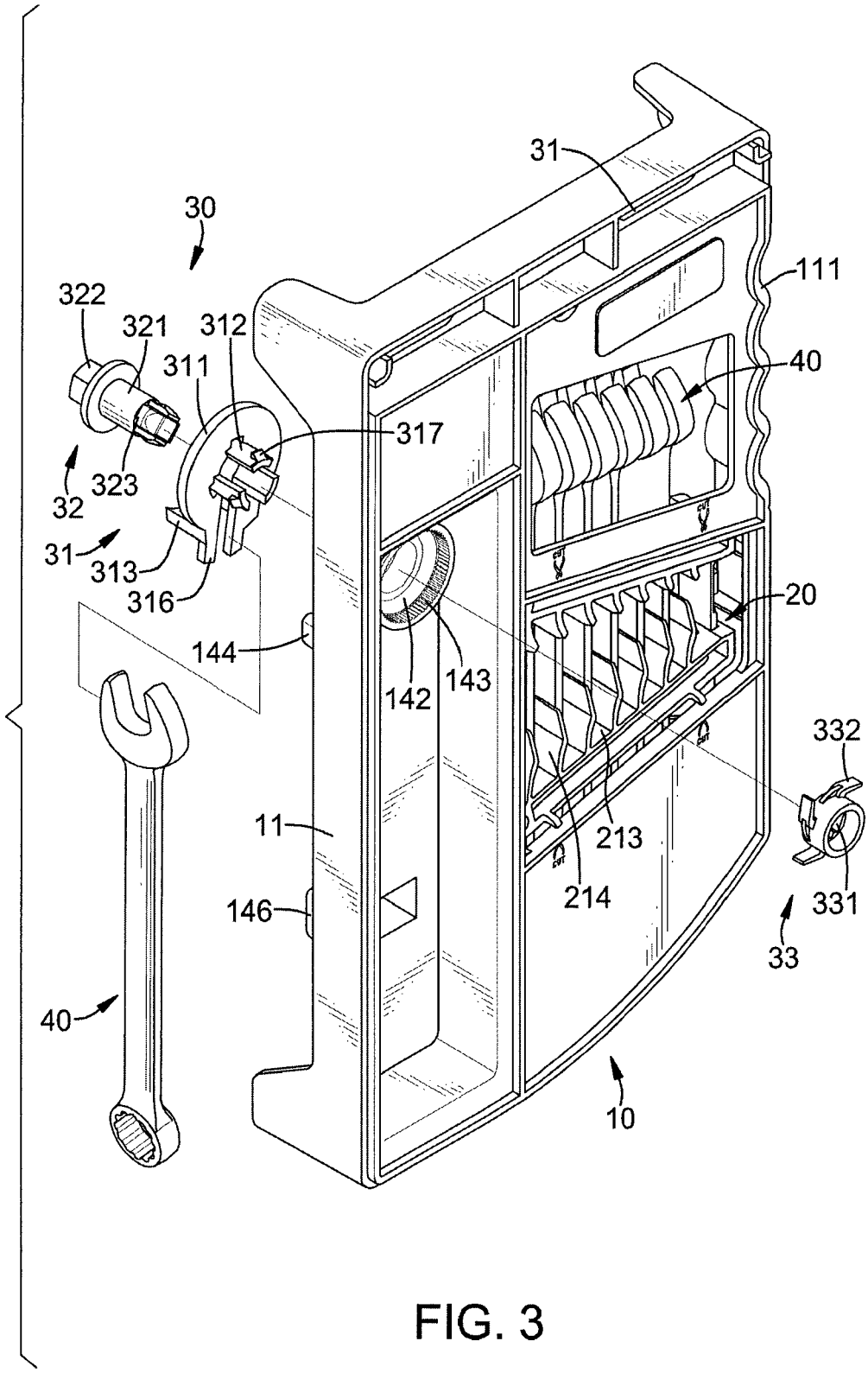
FIG. 3 is another exploded perspective view of a simulation device of the hand tool display box in FIG. 1.
Figure 4:
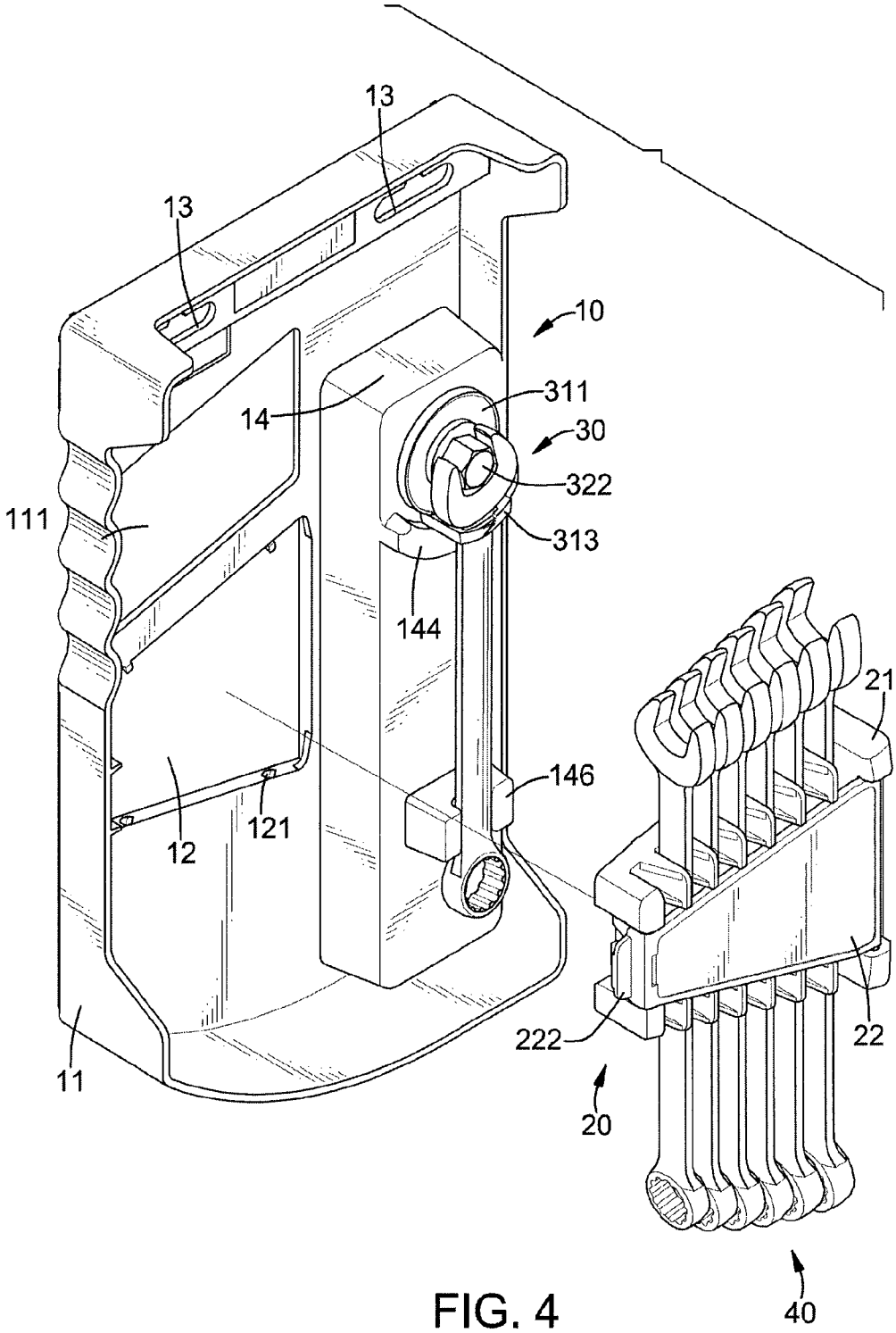
FIG. 4 is an exploded perspective view of a holding device of the hand tool display box in FIG. 1.
Figure 5:
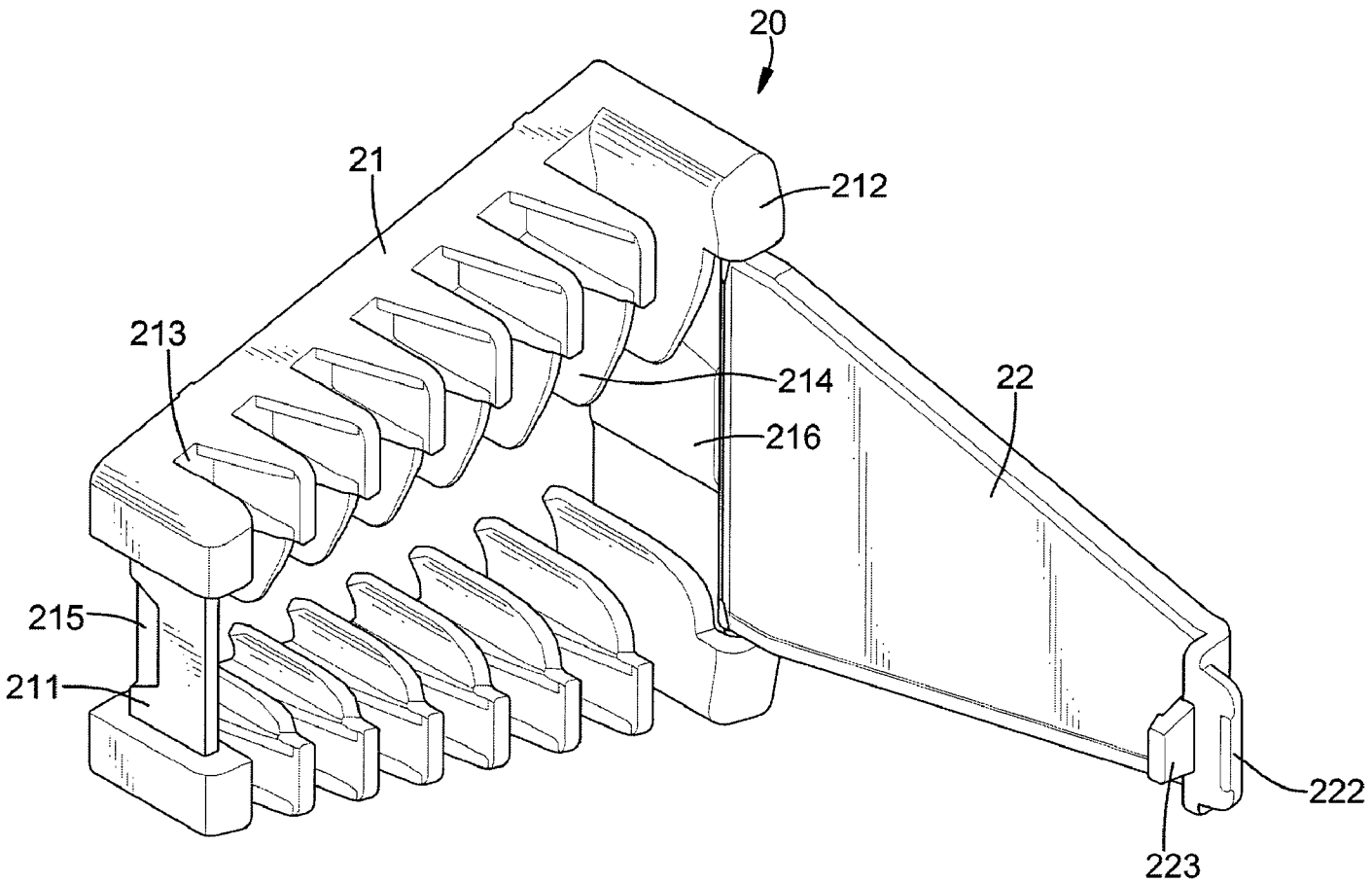
FIG. 5 is an enlarged perspective view of the holding device of the hand tool display box in FIG. 1.
Figure 6:
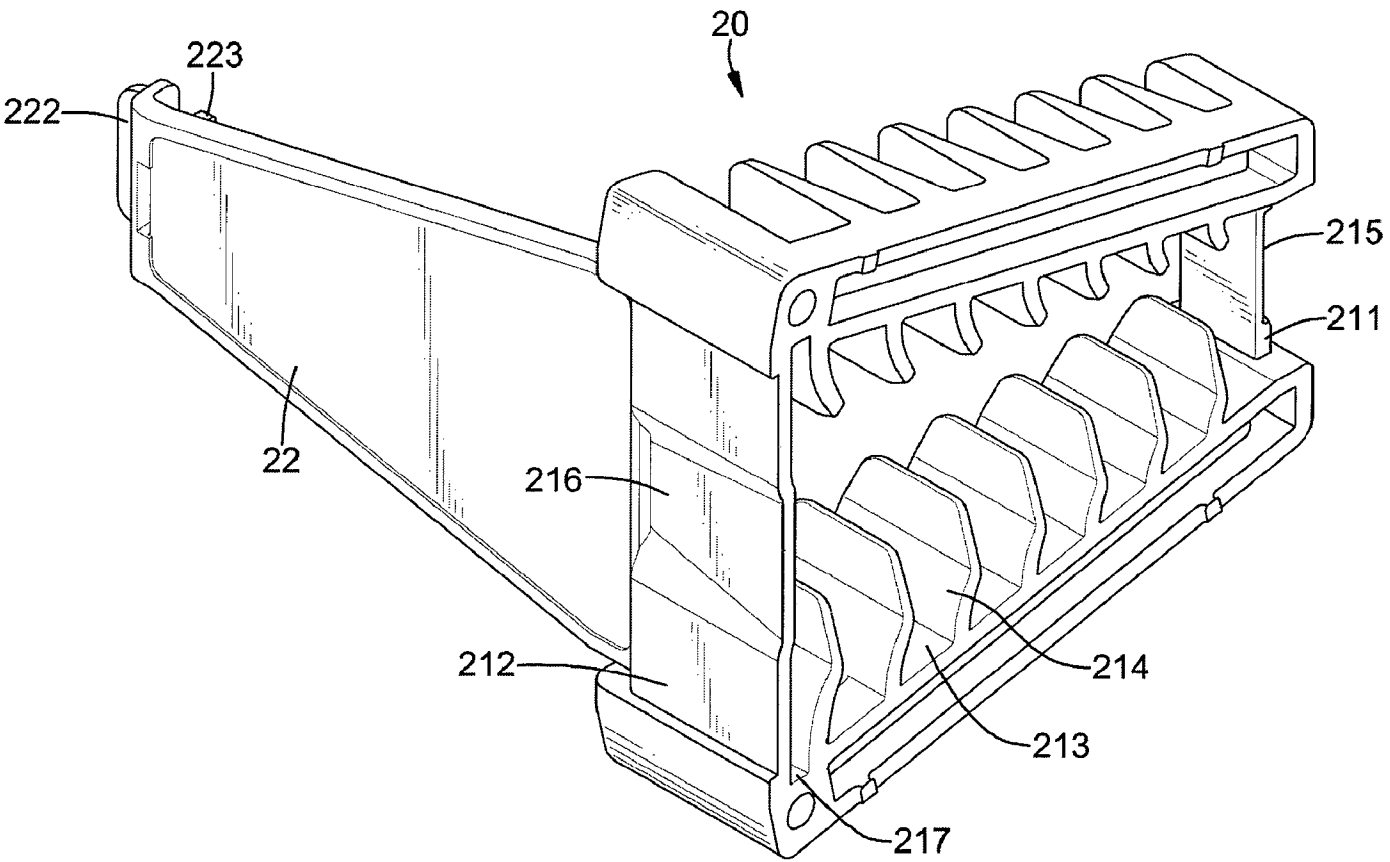
FIG. 6 is another enlarged perspective view of the holding device of the hand tool display box in FIG. 1.
Figure 7:
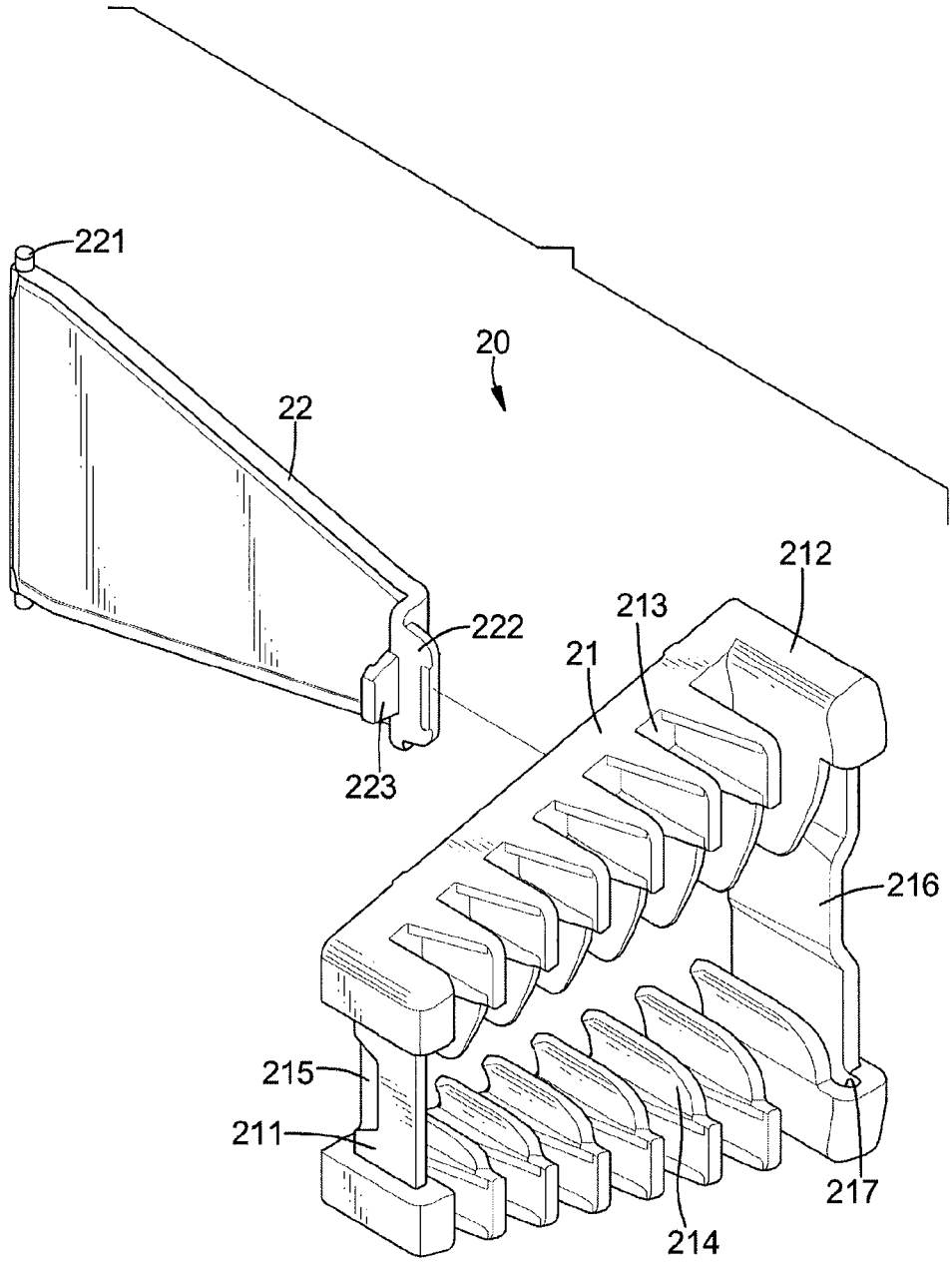
FIG. 7 is an exploded perspective view of the holding device of the hand tool display box in FIG. 5.

With reference to FIGS. 2, 3 and 9, the simulation device (30) is rotatably connected to the mounting seat (14) of the base (10) and has a mounting disk (31), a rotating shaft (32) and an engaging ring (33).

The mounting disk (31) is rotatably connected to the connecting pipe (141) of the mounting seat (14), abuts the front surface of the mounting seat (14) and has a disk (311), multiple inserting feet (312) and a burglarproof protrusion (313). The disk (311) has a bottom, a center, a periphery, a shaft hole (314), an inserting recess (315) and two guiding panels (316). The bottom of the disk (311) abuts the top surface of the mounting seat (14). The shaft hole (314) is axially formed through the center of the disk (311). The inserting recess (315) is radially formed in the disk (311) and communicates with the shaft hole (314). The guiding panels (316) are radially formed on protrude from the periphery of the disk (311) beside the inserting recess (315) and are mounted slidably in the guiding groove (145) of the limiting protrusion (144).

The inserting feet (312) are formed on and protrude from the bottom of the disk (311) around the shaft hole (314), are mounted in the connecting pipe (141) and each inserting foot (312) has a free end, an external surface and a holding protrusion (317). The free ends of the inserting feet (312) are extended out of the open end of the connecting pipe (141). The holding protrusions (317) are respectively formed on and protrude from the external surfaces of the inserting feet (312) and engage the open end of the connecting pipe (141) to hold the disk (311) with the mounting seat (14). Preferably, the mounting disk (31) has three inserting feet (312) formed on and protruding from the bottom of the disk (311) around the shaft hole (314).

The burglarproof protrusion (313) may be U-shaped and is formed on the guiding panel (316) of the disk (311) to form a space between the limiting protrusion (144) and the burglarproof protrusion (313).

The rotating shaft (32) is mounted in the connecting pipe (141) and the mounting tube (142) of the mounting seat (14) via the shaft hole (314) of the disk (311), extends out of the mounting tube (142) and has a body (321), a mounting head (322) and multiple engaging legs (323). The body (321) is rotatably mounted in the mounting disk (31) between the inserting feet (312) and has an inner end and an outer end. The inner end of the body (321) extends into mounting tube (142) of the mounting seat (14). The outer end of the body (321) extends out of the shaft hole (314) of the disk (311). The mounting head (322) may be hexagonal, is formed on the outer end of the body (321) and abuts the disk (311). The engaging legs (323) are formed on and protrude from the inner end of the body (321) at intervals and each engaging leg (323) has an external surface, a free end and an engaging block (324). The engaging blocks (324) are formed on and protrude from the external surfaces at the free ends of the engaging legs (323). Preferably, the rotating shaft (32) has four engaging legs (323) formed on the inner end of the body (321).

The engaging ring (33) is connected to the rotating shaft (32), is mounted around the free ends of the engaging legs (323), engages the mounting tube (142) of the mounting seat (14) and has a center, an internal surface, an external surface, a connecting hole (331), an inner flange and multiple pressing tabs (332). The connecting hole (331) is formed through the center of the engaging ring (33) and is mounted around the rotating shaft (32). Preferably, the connecting hole (331) is cross-shaped. The inner flange is formed on the internal surface of the engaging ring (33) near the connecting hole (331) and abuts against the engaging blocks (324) of the engaging legs (323) to hold the engaging ring (33) with the rotating shaft (32) and to abut the engaging ring (33) with the free ends of the inserting feet (312). The pressing tabs (332) are formed on and protrude from the external surface of the engaging ring (33) at intervals and engage the ratchet teeth (143) of the mounting tube (142) in the mounting seat (14).

When assembling the hand tool display box in accordance with the present invention, with reference to FIG. 1, the holding frame (21) of the holding device (20) is securely mounted on the baseboard of the base (10) by the connecting protrusions (121) formed with the rear side of the holding frame (21). Mounting hand tools such as combination box and open end wrenches (40) in the mounting recesses (213) to clamp with the clamping ribs (214). Rotating the covering panel (22) to lock with the holding frame (21) by the locking panel (223) engaging in the locking recess (215). With reference to FIG. 8, the user's finger can not be inserted into the base (10) between the finger tab (222) and the annular flange (11) to open the covering panel (22) when the covering panel (22) is locked with the holding frame (21), the outer face of the finger tab (222) is parallel to the outer side of the annular flange (11). Then, the wrenches (40) will not be lost or stolen from the holding device (20) and this can provide a burglarproof effect.

With further reference to FIGS. 2 and 3, a combination box and open end wrench (40) can be mounted on the mounting seat (14) between the mounting disk (31) and the rotating shaft (32) of the simulation device (30) to simulate the operating status. An open end of the combination box and open end wrench (40) is extended into the space between the disk (311) and the burglarproof protrusion (313) via the inserting recess (315) and the shaft hole (314). After the open end of the wrench (40) is mounted on the disk (311), the rotating shaft (32) is mounted in the shaft hole (314) to make the open end of the wrench (40) mounting around the mounting head (322).

The inserting feet (312) of the mounting disk (31) are mounted securely in the connecting pipe (141) by the holding protrusions (317) abutting against the free end of the connecting pipe (141). The engaging legs (323) of the rotating shaft (32) are mounted securely in the mounting tube (142) of the mounting seat (14) by the engaging blocks (324) abutting against the inner flange of the engaging ring (33), and the pressing tabs (332) contact and are pressed by the ratchet teeth (143) of the mounting tube (142). When the mounting disk (31) and the rotating shaft (32) are connected to the mounting seat (14) in the connecting pipe (141) and the mounting tube (142), the guiding panels (316) are movably mounted in the guiding groove (145) of the limiting protrusion (144). Then, the open end of the wrench (40) is limited between the mounting head (322), the burglarproof protrusion (313) and the limiting protrusion (144). A box end of the wrench (40) is mounted in the holding recess (147) of the holding mount (146) and the assemblement of the hand tool display box is completed. After assembling the wrenches (40) with the hand tool display box, the hand tool display box can be hung on a surface, such as a wall in a market by the at least one hanging hole (13).

Furthermore, with reference to FIG. 9, when the rotating shaft (32) is connected to the engaging ring (33) in the mounting tube (14), the free ends of the engaging legs (323) are mounted in the engaging ring (33) without extending out of the engaging ring (33). Therefore, the user's finger can not be inserted into the engaging ring (33) to separate the engaging blocks (324) of the engaging legs (323) from the inner flange of the engaging ring (33), and the wrench (40) that are mounted on the mounting seat (14) will not be lost or stolen from the simulation device (30) to provide another burglarproof effect.

Figure 10:
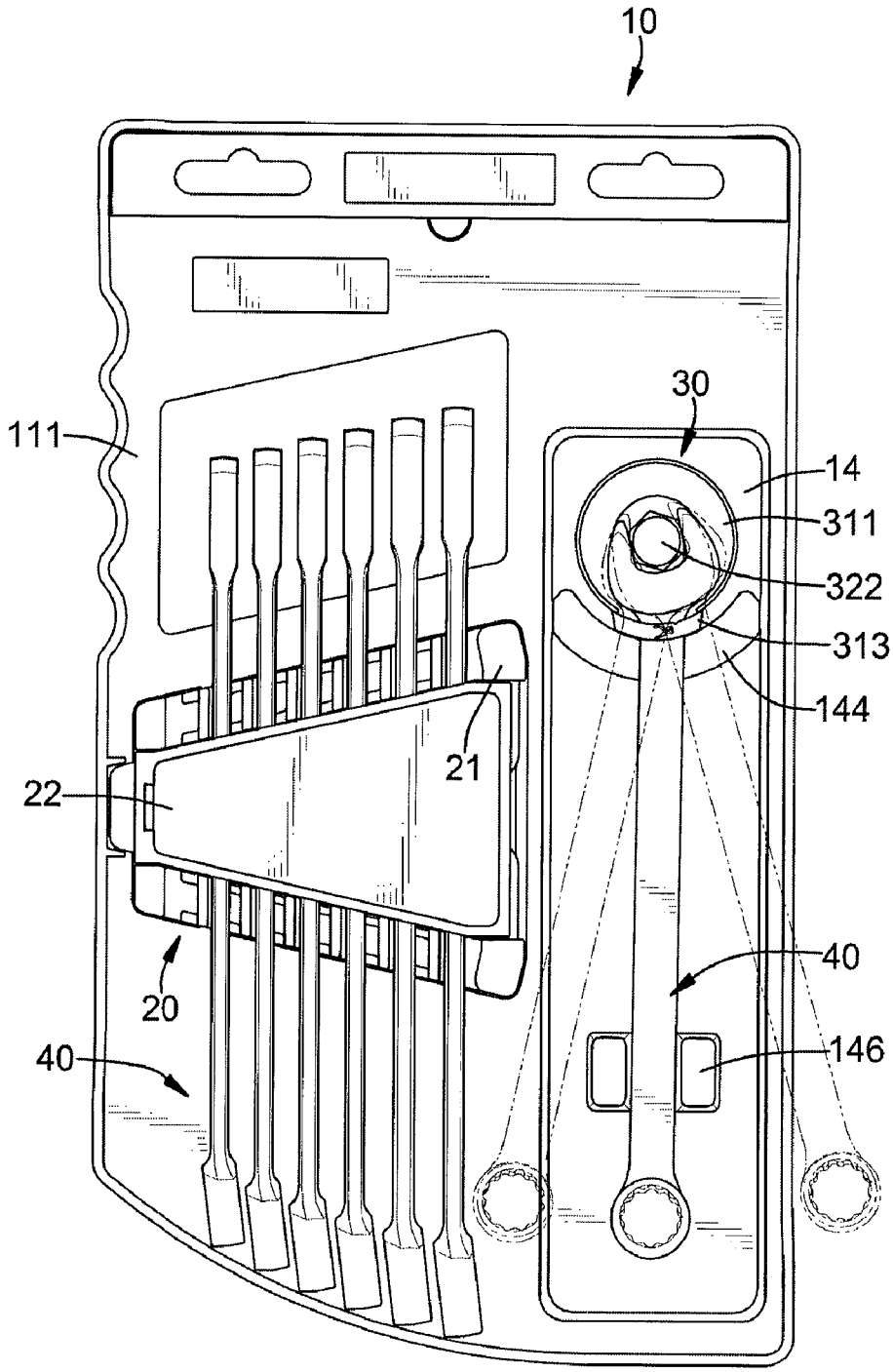
FIG. 10 is an operational side view of the simulation device of the hand tool display box in FIG. 1.

With reference to FIG. 10, a buyer can operate the wrench (40) to simulate the hand feeling of using the wrench (40) before buying the hand tool display box. When simulating the hand feeling of the wrench (40), he or she needs to move the box end of the wrench (40) that is mounted on the mounting seat (14) from the holding recess (147) of the holding mount (146). Then, the buyer can rotate the wrench (40) to simulate the operating status. When rotating the box end of the wrench (40), the rotating shaft (32) will rotate with the wrench (40) by the open end of the wrench (40) mounting around the mounting head (322) of the rotating shaft (32) to make the mounting disk (31) and the engaging ring (33) respectively rotating relative to the connecting pipe (141) and the mounting tube (142). Then, the guiding panels (316) of the disk (311) will move along the guiding groove (145) of the limiting protrusion (144) and the pressing tabs (332) of the engaging ring (33) will move relative to the ratchet teeth (143) on the mounting tube (143) to generate sound to simulate the operating status.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hand tool display box comprising:

a base having
- an upper end;
- a lower end;
- a first side;
- a second side; and
- an outer face;

an annular flange formed around and protruding from the ends and the sides of the baseboard;

a through hole formed through the baseboard near the first side of the baseboard; and a mounting seat formed on and protruding from the baseboard between the second side and the ends of the baseboard and the through hole and having
- a rear surface;
- a front surface;
- a connecting pipe formed on and protruding from the rear surface of the mounting seat near the top end of the baseboard of the base, formed through the front surface of the mounting seat and having a free end;
- a mounting tube formed on and protruding from the rear surface of the mounting seat around the connecting pipe and having
  - an internal surface;
  - an open end; and
  - multiple ratchet teeth formed on the internal surface of the mounting tube near the open end;
- a limiting protrusion being curved and formed on and protruding from the front surface of the mounting seat near the connecting pipe; and
- a holding mount formed on and protruding from the front surface of the mounting seat near the lower end of the baseboard and having a holding recess formed in the holding mount;

a holding device mounted on the base and having a holding frame mounted on the baseboard of the base in the through hole and having
- a rear side mounted on the baseboard of the base above the through hole;
- a front side;
- a locking end adjacent to the first side of the baseboard;
- a connecting end adjacent to the mounting seat of the base and having a middle;
- multiple mounting recesses formed in the holding frame at intervals;
- multiple clamping ribs formed on the holding frame and extended into the mounting recesses; and
- a locking recess formed on the locking end of the holding frame near the rear side of the holding frame; and a covering panel pivotally connected to the holding frame and having
- a pivotal end pivotally connected to the connecting end of the holding frame;
- a locking end connected to the locking end of the holding frame;
- a finger tab formed on and protruding from the locking end of the covering panel and having an inner face and an outer face parallel an outer side of the annular flange; and
- a locking panel formed on and protruding from the inner face of the finger tab and locked in the locking recess of the holding frame; and a simulation device rotatably connected to the mounting seat of the base.

2. The hand tool display box as claimed in claim 1, wherein the simulation device has a mounting disk rotatably connected to the connecting pipe of the mounting seat, abutting the front surface of the mounting seat and having a disk having a bottom abutting the top surface of the mounting seat;

a center;

a periphery;

a shaft hole axially formed through the center of the disk; and an inserting recess radially formed in the disk and communicating with the shaft hole;

multiple inserting feet formed on and protruding from the bottom of the disk around the shaft hole, mounted in the connecting pipe and each inserting foot having a free end extended out of the open end of the connecting pipe;

an external surface; and a holding protrusion formed on and protruding from the external surface of the inserting foot and engaging the open end of the connecting pipe to hold the disk with the mounting seat; and a burglarproof protrusion formed on the guiding panel of the disk to form a space between the limiting protrusion and the burglarproof protrusion;

a rotating shaft mounted in the connecting pipe and the mounting tube of the mounting seat via the shaft hole of the disk and extended out of the mounting tube; and an engaging ring connected to the rotating shaft and engaging the mounting tube of the mounting seat.

3. The hand tool display box as claimed in claim 2, wherein the limiting protrusion has an upper face faced the upper end of the baseboard; and a guiding groove formed through the upper face of the limiting protrusion; and the disk has two guiding panels radially formed on protruding from the periphery of the disk beside the inserting recess and mounted in the guiding groove of the limiting protrusion.

4. The hand tool display box as claimed in, claim 3, wherein the rotating shaft has a body rotatably mounted in the mounting disk between the inserting feet and having an inner end extended into mounting tube of the mounting seat; and an outer end extended out of the shaft hole of the disk;

a mounting head formed on the outer end of the body and abutting the disk; and multiple engaging legs formed on and protruding from the inner end of the body at intervals and each engaging leg having an external surface;

a free end; and an engaging block formed on and protruding from the external surface at the free end of the engaging leg.

5. The hand tool display box as claimed in claim 4, wherein the engaging ring is mounted around the free ends of the engaging legs and has a center;

an internal surface;

an external surface;

a connecting hole formed through the center of the engaging ring and mounted around the rotating shaft;

an inner flange formed on the internal surface of the engaging ring near the connecting hole, abutting against the engaging blocks of the engaging legs to hold the engaging ring with the rotating shaft and abutting the engaging ring with the free ends of the inserting feet; and multiple pressing tabs formed on and protruding from the external surface of the engaging ring at intervals and engaging the ratchet teeth of the mounting tube in the mounting seat.

6. The hand tool display box as claimed in claim 5, wherein the holding frame has a holding segment formed on and protruding inward from the middle of the connecting end of the holding frame; and a panel recess formed through the rear side of the holding frame in the connecting end;

the pivotal end of the covering panel abutting with the holding segment of the holding frame; and the covering panel has two pivotal rods formed on and protruding from the pivotal end of the covering panel and rotatably mounted in the panel recess of the holding frame.

7. The hand tool display box as claimed in claim 6, wherein the base has multiple connecting protrusions formed in the through hole and protrude from the top face of the baseboard; and the bottom of the holding frame is formed with the connecting protrusions of the base.

8. The hand tool display box as claimed in claim 7, wherein the base has at least one hanging hole formed through the top end of the baseboard.

9. The hand tool display box as claimed in claim 8, wherein the annular flange is curved at the lower end of the baseboard and has a finger recess formed on the annular flange near the top end of the baseboard;

the through hole is formed through the baseboard near the finger recess of the annular flange;

the locking end of the holding frame is closed to the annular flange near the finger recess.

10. The hand tool display box as claimed in claim 9, wherein the mounting disk has three inserting feet formed on and protrude from the bottom of the disk around the shaft hole; and the rotating shaft has four engaging legs formed on the inner end of the body.

11. The hand tool display box as claimed in claim 10, wherein the base is rectangular;

through hole is trapezoidal;

the mounting head is hexagonal; and the connecting hole is cross-shaped.

* * * * *